United States Patent [19]

Van Burkleo

[11] 4,034,732

[45] July 12, 1977

[54] NON-INCENDIVE SHUT-DOWN SYSTEM FOR ENGINE MAGNETOS

[75] Inventor: Glenn G. Van Burkleo, Corpus Christi, Tex.

[73] Assignee: Exxon Production Research Company, Houston, Tex.

[21] Appl. No.: 594,834

[22] Filed: July 10, 1975

[51] Int. Cl.[2] ..... F02B 77/00

[52] U.S. Cl. ..... 123/198 DC; 123/118; 123/148 S; 123/148 CC

[58] Field of Search ..... 123/198 D, 198 DC, 118, 123/148 S, 148 E, 148 CC

[56] References Cited

U.S. PATENT DOCUMENTS

| | | | |
|---|---|---|---|
| 3,601,103 | 8/1971 | Swiden | 123/198 DC X |
| 3,680,539 | 8/1972 | Savage et al. | 123/198 DC X |
| 3,726,265 | 4/1973 | Howard | 123/198 DC X |

*Primary Examiner*—Carroll B. Dority, Jr.
*Assistant Examiner*—Ira S. Lazarus
*Attorney, Agent, or Firm*—John S. Schneider

[57] ABSTRACT

A shut-down system for an internal combustion engine having a magneto circuit which when grounded causes the engine to shut down. A normally open sensor switch responsive to some malfunction of the engine grounds the magneto circuit through an "indicator" circuit when the sensor switch closes. To avoid arcing with sufficient energy release to ignite flammable mixtures of gases or dust which might occur when ordinary switch contacts are operated, non-arcing solid state switches are used in those parts of the system which handle ignition levels of electrical energy and means are provided for reducing to non-ignition levels the electrical energy that is handled by ordinary switch contacts in the system. In addition, means may be provided to remove magneto primary voltage from the system for a short period of time while the engine is being started up so that the magneto circuit is not grounded by operation of the sensor switch before the engine reaches running conditions. The system can be extended to accommodate any number of indicator circuits and sensor switches. A "test without kill" feature may be added in order to test the integrity of the sensor switch wiring and the proper functioning of the overall system without killing the engine. Further, a hard-ground feature may be included in the event the impedance of a coil in the indicator circuit through which the magneto circuit is grounded is too high to effectively ground the magneto circuit. Also, a manual shut-down or "kill" switch may be included. In addition, a matrix arrangement for connecting various sensor switches and indicator circuits may be employed to reduce the number of indicator circuits required to identify uniquely four or more primary sensor points and to provide a redundant shut-down path should one of the indicator circuits fail.

6 Claims, 2 Drawing Figures

NON-INCENDIVE SHUT-DOWN SYSTEM FOR ENGINE MAGNETOS

BACKGROUND OF THE INVENTION

1. Field of the invention.

This invention relates to circuits for controlling operation of internal combustion engine ignition systems that utilize magnetos and, in particular, non-incendive shut-down systems for such engines. The terms "incendive" and "non-incendive" as used herein mean having and not having, respectively, enough electrical energy to ignite; see National Electrical Code, 1975, published by National Fire Protection Association, page 70–352, paragraph 501–3. (b) (1) (c).

2. Prior Art

Stationary internal combustion engines operating unattended for long periods of time frequently are equipped with automatic shut-down devices to protect the engine from expensive damage should serious malfunctions, such as low lube oil pressure, high jacketwater temperature, or excessive vibration, occur. Companion to the shut-down system is an annuciator panel which shows which of the primary sensing elements (low oil switch, etc.) caused the engine to shut down. This "indicator" panel is useful to the operator or service man in pinpointing the malfunction and simplifies the problem of repair. Conventional electronic shut-down panels draw their operating power from the engine magneto system and upon actuation shut the engine down by grounding the magneto primary circuit. When this circuit is grounded through ordinary contacts arcing can occur with sufficient energy release to ignite flammable mixtures of gases or dust.

The present invention discloses a means for substituting non-arcing, solid state switches in those portions of the circuit handling incendive levels of electrical energy and a means for reducing to non-incendive levels the electrical energy that must be handled by ordinary contacts in the circuit. Arranging the circuit in this manner permits the use of ordinary contacts and general purpose enclosures in National Electrical Code Division 2 areas where, otherwise, special contacts would be required as, for example, contacts which are hermetically sealed or immersed in oil or contained in explosion-proof enclosures. Special contacts and explosion-proof enclosures would always be more costly than the system proposed by this invention; and in some cases, suitable equipment that would provide a degree of safety equivalent to that of the system of the present invention is not available.

SUMMARY OF THE INVENTION

A shut-down system for an internal combustion engine that has a magneto circuit which when grounded shuts the engine down comprising a sensor switch responsive to a malfunction of the engine; an indicator circuit connected to the magneto circuit and to the sensor switch which includes non-arcing solid state switches for handling incendive levels of electrical energy; and means for reducing to non-incendive levels electrical energy handled by conventional contact switches, said means grounding the magneto circuit upon operation of the sensor switch. A plurality of indicator circuits and sensor switches may be employed in the system. Another circuit connected to the magneto circuit and the sensor switch and indicator circuit may be included to delay operation of the system for a selected period of time to permit the engine to start up. Also, circuit means may be added which determines integrity of the sensor wiring and proper functioning of the indicators without killing the engine. In addition, a hardground feature may be added to the system in the event the impedance of the coils of the indicators are too high to ground the magneto effectively. Further, a matrix arrangement may be used for connecting the sensors to the indicator circuits to reduce the number of indicator circuits required to identify uniquely four or more primary sensor points and to provide a redundant shut-down path should one indicator circuit fail.

DETAILED DESCRIPTION

Figure 1:
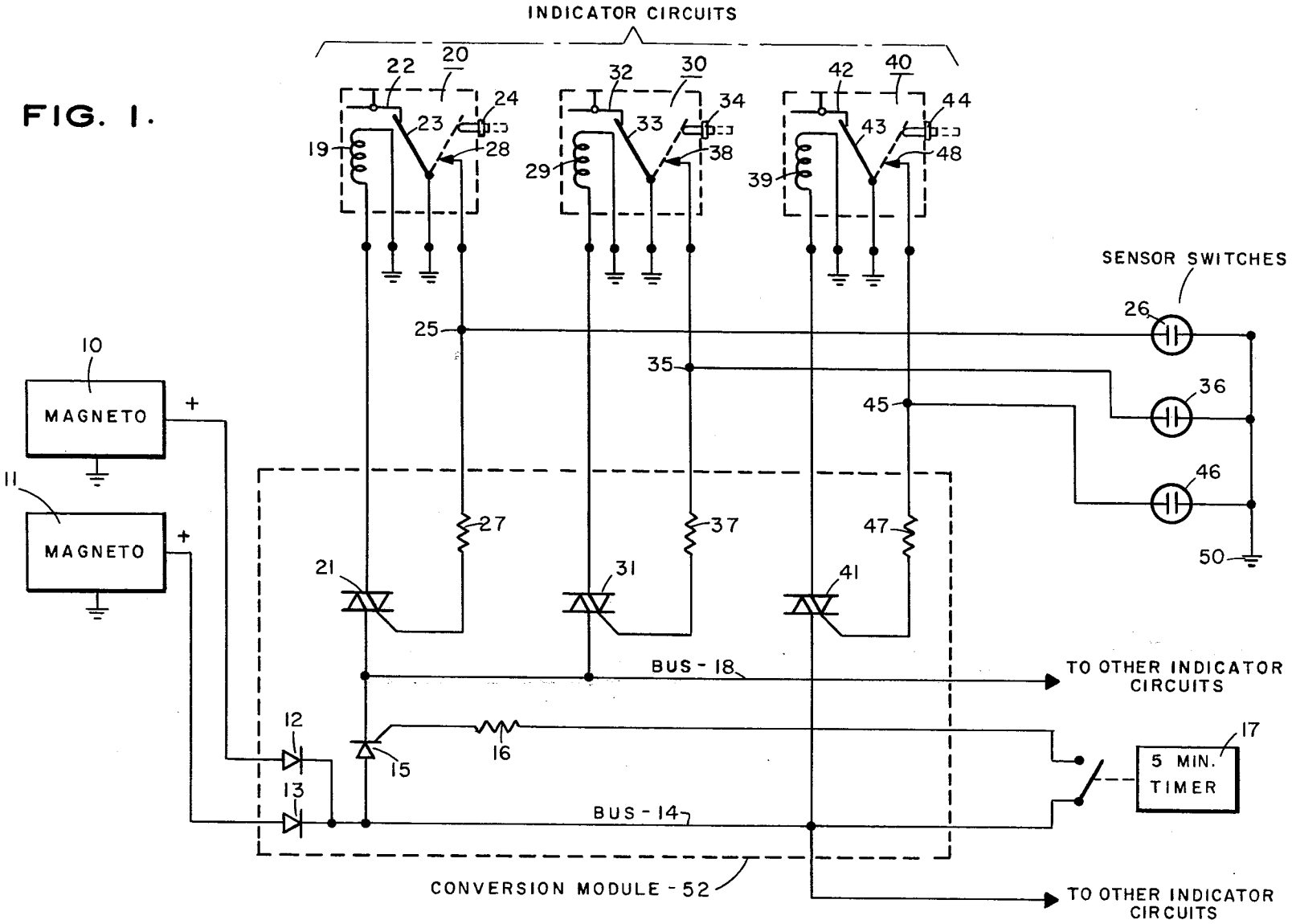
FIG. 1 is a schematic diagram of the nonincendive shut-down system of the invention.

Referring to FIG. 1 the kill-circuits of two engine magnetos 10 and 11 are shown tied together through diodes 12 and 13 to a primary voltage bus 14 and the anode of a silicon controlled rectifier (SCR) 15. The gate of SCR 15 is connected, through resistor 16 (e.g. 4700 ohms) to one terminal of a five-minute timer switch 17. Bus 14 is connected to the other terminal of switch 17. The cathode of SCR 15 is connected to another bus 18. The cathode of SCR 15 and bus 18 are connected to a coil 19 of an indicator circuit 20 through a gate-controlled semiconductor switch (SCS) 21 designed for alternating or direct current power control. Indicator circuit 20 also includes a releasable latch 22 which controls springloaded lever arm 23, movable from the solid line to the dashed line position shown to contact signal means 24 (e.g. reset pop-out button) and vice versa, as indicated. Switch 21 is tied to sensor terminal 25 of a sensor switch 26 through a resistor 27. Terminal 25 also connects into indicator circuit 20 by contact 28 when lever arm 23 is in its dotted line position.

Bus 18 is also tied to ground through a coil 29 of an indicator circuit 30 through a gate controlled semiconductor switch 31 (the same as SCS 21). Bus 14 is similarly tied to a ground through a coil 39 of an indicator circuit 40 through a gate controlled semiconductor or SCS 41 (also the same as SCS 21). Each indicator circuit 30 and 40 has releasable latches 32 and 42, respectively, each of which controls spring loaded-movable lever arms 33 and 43, respectively, and a signal means therefor 34 and 44, respectively. SCS 31 is connected to sensor terminal 35 of a sensor 36 through a resistor 37 and SCS 41 is connected to a sensor terminal 45 of a sensor 46 through a resistor 47. Sensor switches 26, 36, and 46 are grounded as indicated at 50.

The magneto kill circuits are assumed to be positive with respect to circuit ground, but the principle of this invention would apply equally well to negative magneto kill circuits by reversing connections to the diodes 12 and 13, SCR 15 and the three gate controlled semiconductor switches 21, 31 and 41.

When SCR 15 is conducting, magneto primary voltage appears on bus 18 but no current flows in any of the indicator coils 19, 29 and 39 until one of the switches 21, 31 or 41 is triggered into conduction. Such triggering occurs when one of the sensor switches (26, 36 or 46) closes and puts system ground on the gate of switch 21, 31 or 41. If the sensor switch 26 contacts close when, say oil pressure, gets too low, the gate of switch 21 is grounded through resistor 27, switch 21 is triggered into conduction and current is allowed to flow through coil 19 of indicator 20. This drops the magneto voltage to near zero and kills the engine. It also trips springloaded lever arm 23 in indicator 20 which puts ground on the gate of switch 21 through contact 28 until lever arm 23 in indicator 20 is reset. Such action ensures that the engine is shut down after sensor switch 26 closes, even through switch 26 may reopen as the engine speed drops.

Similarly, if the sensor switch 36 contacts close when, for example, engine speed (revolutions/minute-rpm) gets too low, the gate of switch 31 is grounded through resistor 37, switch 31 is triggered into conduction and current is allowed to flow through coil 29 of indicator 30. The magneto voltage is thereby dropped to near zero and kills the engine. A spring-loaded lever 33 puts ground on the gate of switch 31 through contact 38 until indicator 30 is reset. That action ensures that the engine is shut down after sensor switch closes even though switch 36 may reopen.

The kill circuit for sensor switch 46 has similar components and operates the same as the kill circuits for sensor switches 36 and 26 described above. Thus, if sensor switch 46 contacts close when engine rpm gets too high the gate of switch 41 is grounded through resistor 47, SCS 41 conducts and current flows through coil 39 of indicator 40. The magneto voltage drops and kills the engine. A spring-loaded lever arm 43 puts ground on the gate of SCS 41 through contact 48 until indicator 40 is reset to ensure that the engine remains shut down after sensor switch 46 closes even through switch 46 may reopen.

The indicator is a magnetic switch modified by internal reconnection as described. The maximum current that flows through the diodes 12 and 13, SCR 15, switch 21 and coil 19 of indicator 20 is sufficient to ignite explosive mixtures of gases or dust if arcing at conventional contacts occurred. However, with the circuit arrangement of this invention there are no contacts in this part of the circuit. The current that flows through diodes 12 and 13, SCR 15 and the gate of switch 21 is limited by resistor 27 to a value below incendive levels and, therefore, the contacts at sensor switch 26 do not constitute an ignition source. The value of gate resistor 27 (and 37 and 47) is chosen to provide reliable triggering while keeping the current in the trigger circuit acceptably low. For magnetos generating primary voltages in the 100 to 350 volt range, a resistance value of 4700 ohms would be appropriate.

Indicator 30 operates in the same manner as indicator 20 but represents some other malfunction, such as low engine rpm. Indicator 40 also operates the same as indicator 20 except that it might represent a malfunction, such as high rpm, and is connected to bus 14 ahead or upstream of SCR 15. The function of SCR 15 and five-minute timer 17 is to remove magneto primary voltage from bus 18 for five minutes while an engine is being started. Such delay prevents indicators (defeatable) representing low oil pressure (20) and low engine rpm (30) from grounding the magneto before the engine reaches running conditions. It may be desirable, however, for other indicators, such as those monitoring high engine rpm, to remain in service during start-up. Therefore, these indicators, such as indicator 40, are connected to bus 14 upstream of SCR 15 so that they are not disabled (non-defeatable) when the five-minute timer switch is opened for engine startup. It should be noted that, although the 5-minute timer has conventional contacts, they do not constitute an ignition source since the current in the trigger circuit of SCR 15 is below ignition levels due to the limiting action of resistor 16.

The circuit disclosed herein can be extended to accommodate any number of indicators and sensors. As shown bus 18 may be connected to other "defeatable" indicator switches and bus 14 may be connected to other "non-defeatable" indicator switches. Furthermore, as indicated, the components can be arranged on one conversion module board, indicated by the dashed lines as at 52, or the parts can be mounted in or on existing devices. For example, it is convenient to mount switch 21 and resistor 27 inside the housing of indicator 20; switch 31 and resistor 37 inside the housing of indicator 30 and switch 41 and resistor 47 inside the housing of indicator 40 and so forth. SCR 15, resistor 16 and diodes 12 and 13 can be mounted on the back side of the five-minute timer switch 17. Thus, with care in component selection and layout the means disposed therein would also qualify the indicators and timer switch for an intrinsically safe rating as well as a non-incendive rating. An intrinsically safe rating would mean that the devices could be safely used in National Electric Code Division 1 as well as Division 2 areas.

Figure 2:
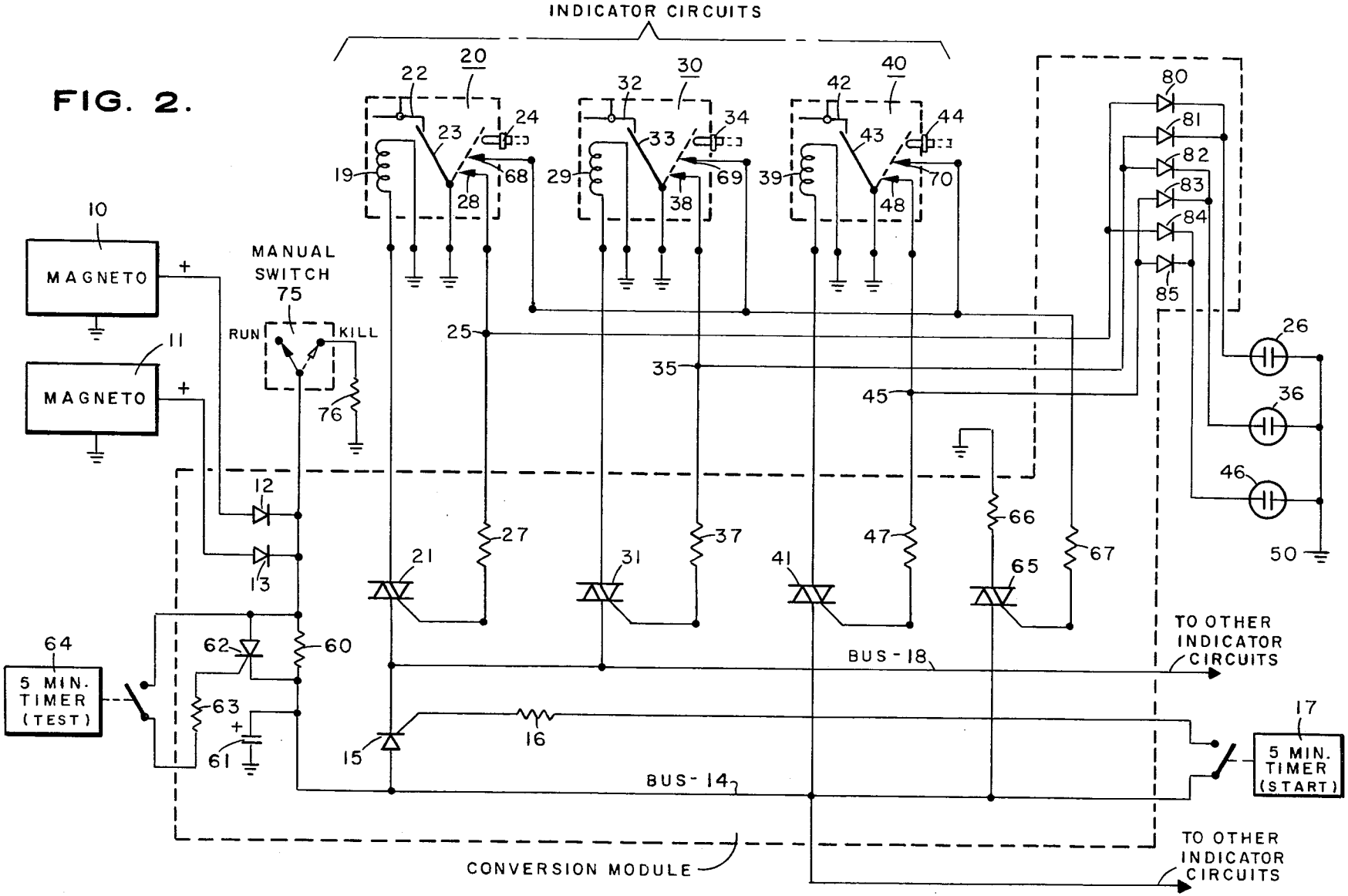
FIG. 2 is a schematic diagram of the system of FIG. 1 with added features.

The circuit of FIG. 2 contains the same components and operates the same as the circuit shown in FIG. 1 except for the following additions:

A "test without kill" feature has been added in FIG. 2 so that integrity of the sensor wiring and proper functioning of the indicators can be confirmed without killing the engine. This is accomplished by adding a resistor 60, capacitor 61, SCR 62, resistor 63 and a 5-minute spring-wound "test" timer 64 with conventional form A contacts. With the test timer 64 set and SCR 62 nonconductive, resistor 60 is inserted in series between the magnetos 10 and 11 and voltage buses 14 and 18. In this condition one of the sensor switches 26, 36 or 46 can be closed and its corresponding indicator tripped using energy stored in capacitor 61. This will not, however, kill the engine since resistance 60 (about 20,000 ohms) limits the drain on magnetos to a few milliamperes. When the indicator is reset, capacitor 61 (e.g. 100 microfarads) recharges through resistor 60 within a few seconds and testing can continue. After testing is completed test timer 64 is reset to its closed-contact position and resistor 60 is shunted by SCR 62. Should an indicator then trip, the magnetos would be grounded through a low impedance and the engine would die. Automatic time-out of the test timer ensures that the circuit cannot be inadvertently left in the test position. Resistor 63 (e.g. 4700 ohms) limits current through the timer contacts to non-incendive levels.

A "hard ground" feature has also been added to the circuit through use of SCS 65, resistor 66 (e.g. 47 ohms), resistor 67 (e.g. 4700 ohms) and auxiliary contacts 68, 69 and 70 in each of the indicators. Such addition is necessary because the impedance of some indicator coils is too high to ground the magnetos effectively. When any indicator trips in this circuit, it places a ground on the gate of switch 65 through the auxiliary indicator contacts 68, 69 or 70 and resistor 67. This triggers switch 65 into conduction and grounds the magnetos through resistor 66, a low resistance of about 47 ohms. A low resistance ground path results in good kill characteristics and prevents lugging and backfiring of the engine as it dies.

The manual kill switch is a standard feature of most panels and is illustrated herein at 75 to point out the necessity of replacing conventional contact switches with hermetically sealed or explosion-proof units. Resistor 76 (about 47 ohms) limits in-rush current and arcing to a level that prolongs contact life and avoids damage to other circuit components.

The circuit of FIG. 2 also adds a diode matrix scheme, indicated by diodes 80, 81, 82, 83, 84 and 85, for connecting the indicators. This matrix connection has two important features: (1) it reduces the number of indicator circuits required to identify uniquely four or more primary sensor points and (2) it provides a redundant shut-down path should one indicator circuit fail. Failure of one indicator path would destroy unique identification of the point that shut the engine down but shut-down would occur and a dangerous or damaging situation would be avoided. Matrixing is purposely limited to two indicators per sensor so that the energy stored on capacitor 61 will not have to be divided among more coils than can be reliably tripped. Only two indicators per sensor also simplifies operator interpretation when a shut-down occurs or when a panel is being tested. If more or less than two indicators are tripped the panel is recognized as faulty and can be repaired before catastrophic failure occurs. For simplification, only three indicators are shown and matrixed in FIG. 2 but any number can be connected in this manner. Eight indicators matrixed to where two trip at a time will uniquely identify 28 sensor points. Other capacities can be calculated from the formula $$P = \frac{N!}{2(N-2)!}, \text{ where:}$$

$P$ = number of sensor points uniquely identified $N$ = number of indicators tripped two at a time.

All components for the system are well known in the art and are commercially available. Time switches such as timers 17 and 64, sensor switches such as switches 26, 36 and 46 and indicators such as indicators 20, 30 and 40 may suitably be a timer, switches and indicators (Model 101-D magnetic switch) such as manufactured by the Frank W. Murphy Manufacturer, Inc. company, Tulsa, Oklahoma.

Changes and modifications may be made in the illustrative embodiments of the invention shown and/or described herein without departing from the scope of the invention as defined in the appended claims.

Having fully described the nature, operation, advantages and objects of my invention I claim:

1. In a shut-down system for an internal combustion engine having a magneto circuit, said shut-down system including at least one sensor contact switch operable in response to a malfunction of said engine, and at least one indicator means which includes a switching means for generating a signal indicative of said malfunction, the improvement comprising:

a first semiconductor current switch having a control terminal coupled to said sensor contact switch to change the conducting state of said first semiconductor switch in response to a malfunction of said engine and having a current switching terminal coupled to said switching means to generate said signal indicating said malfunction and a second semiconductor current switch having a control terminal coupled to said switching means to change the state of said second semiconductor current switch to its conducting state in response to a malfunction indication and having a current switching terminal connected through a low impedance path to said magneto circuit, said second semiconductor current switch providing a low impedance current conducting path from said magneto circuit which disables said engine.

2. A shut-down system as recited in claim 1 including means connected to said magneto circuit and said indicator means for delaying operation of said shut-down system for a selected period of time.

3. A system as recited in claim 2 including means connected between said magneto circuit and said indicator means for testing operation of said sensor switch and said indicator means to ensure integrity of said sensor switch and proper functioning of said system without stopping said engine.

4. A system as recited in claim 3 including an additional ground circuit connected into said indicator means to ground said magneto circuit when the impedance in said indicator means is too high.

5. A system as recited in claim 4 including a matrix arrangement of diodes connected between said sensor switch and said indicator means to reduce the number of indicator means required to identify sensor points and to provide a redundant shut-down path should one indicator means fail.

6. A shut-down system for an internal combustion engine as recited in claim 1 including a plurality of sensor contact switches, each closeable to ground in response to a different malfunction of said engine; and a plurality of indicator means, each indicator means connecting a different one of said sensor contact switches to said magneto circuit to ground said magneto circuit upon closing of any one of said sensor contact switches.

* * * * *